US005934251A

United States Patent [19]

Jacobs

[11] Patent Number: 5,934,251

[45] Date of Patent: Aug. 10, 1999

[54] FUEL SYSTEM DAMPER WITH VACUUM BIAS

[75] Inventor: Michael Alan Jacobs, Yorktown, Va.

[73] Assignee: Siemens Automotive Corporation, Auburn Hills, Mich.

[21] Appl. No.: 09/079,345

[22] Filed: May 15, 1998

[51] Int. Cl.[6] ..... F02M 37/04

[52] U.S. Cl. ..... 123/447; 123/467; 123/463

[58] Field of Search ..... 123/447, 467, 123/463, 456

[56] References Cited

U.S. PATENT DOCUMENTS

| | | | |
|---|---|---|---|
| 4,195,668 | 4/1980 | Lewis . | |
| 4,205,637 | 6/1980 | Ito et al. . | |
| 4,562,816 | 1/1986 | Dorr . | |
| 4,615,320 | 10/1986 | Fehrenbach et al. . | |
| 4,679,537 | 7/1987 | Fehrenbach et al. . | |
| 4,756,289 | 7/1988 | Rock | 123/447 |
| 4,979,674 | 12/1990 | Taira et al. . | |
| 4,996,963 | 3/1991 | Fehrenbach | 123/447 |
| 5,088,463 | 2/1992 | Affeldt et al. . | |
| 5,163,472 | 11/1992 | Takada | 123/447 |
| 5,275,203 | 1/1994 | Robinson | 123/463 |
| 5,381,816 | 1/1995 | Alsobrooks | 123/463 |
| 5,394,900 | 3/1995 | Okuyama | 123/463 |
| 5,413,077 | 5/1995 | Hornby | 123/463 |
| 5,520,215 | 5/1996 | Haboush | 123/467 |
| 5,579,739 | 12/1996 | Tuckey . | |
| 5,590,631 | 1/1997 | Tuckey | 123/447 |

*Primary Examiner*—Carl S. Miller

[57] ABSTRACT

A fuel system damper includes a damper diaphragm, a damper spring, a vacuum bias diaphragm, and a vacuum bias spring. The damper spring is biased between the damper diaphragm and the vacuum bias diaphragm, and the vacuum bias spring is biased against the vacuum bias diaphragm in the top chamber of the damper. A bottom chamber below the damper diaphragm is open to allow fuel from the fuel rail into the chamber so that the damper diaphragm can respond to pressure pulsations in the fuel. The top chamber has an opening that communicates with an engine intake manifold so that when engine intake manifold pressure decreases to very low levels, the vacuum bias diaphragm will travel up. This upward motion reduces the pressure in the fuel rail by removing load from the damper spring. When the pressure regulation setpoint is reached, the regulator will supply fuel to maintain pressure.

14 Claims, 2 Drawing Sheets

FUEL SYSTEM DAMPER WITH VACUUM BIAS

FIELD OF THE INVENTION

This invention relates to dampers for relieving fuel pressure pulsations in automotive fuel systems, and more particularly to dampers which correct large magnitude transient pressure changes.

BACKGROUND OF THE INVENTION

Currently, automotive fuel systems use various types of dampers to eliminate pressure pulsations that occur in fuel rails. These dampers typically consist of a flexible diaphragm exposed to the fuel rail pressure, such that the compliance of the flexible diaphragm absorbs the fuel pressure pulsations.

A problem that is not well addressed by current damper designs is the occurrence of large magnitude changes in pressure during transient engine operating conditions. This problem is more severe in fuel systems with returnless regulators. In these systems, there is an increase in fuel system pressure during rapid engine deceleration. This is due to the rapid closing of the regulator valve combined with the greatly reduced injector flow required for engine operation in this condition.

SUMMARY OF THE INVENTION

A fuel system damper is provided to relieve pressure pulsations and correct transient pressure changes. The damper includes a damper diaphragm, a damper spring, a vacuum bias diaphragm, and a vacuum bias spring. The damper spring is biased between the damper seat and the damper spring seat, and the vacuum bias spring is biased against the vacuum bias spring seat in the top chamber of the damper. A bottom chamber below the damper diaphragm is open to allow fuel from the fuel rail into the chamber so that the damper diaphragm can respond to pressure pulsations in the fuel. The top chamber has an opening that communicates with an engine intake manifold so that when engine intake manifold pressure decreases to very low levels, the vacuum bias diaphragm will travel up. This upward motion reduces the pressure in the fuel rail by removing load from the damper spring causing the damper diaphragm to move up and increase the volume of the fuel rail. This movement of the damper diaphragm will cause the fuel system pressure to be reduced to the regulation setpoint. When the pressure regulation setpoint is reached, the regulator will supply fuel to maintain pressure in the fuel rail. Thus, the present invention, including an engine vacuum bias feature, provides a means of improving the effectiveness of fuel system pressure pulsation dampers.

DETAILED DESCRIPTION OF THE INVENTION

Figure 1:
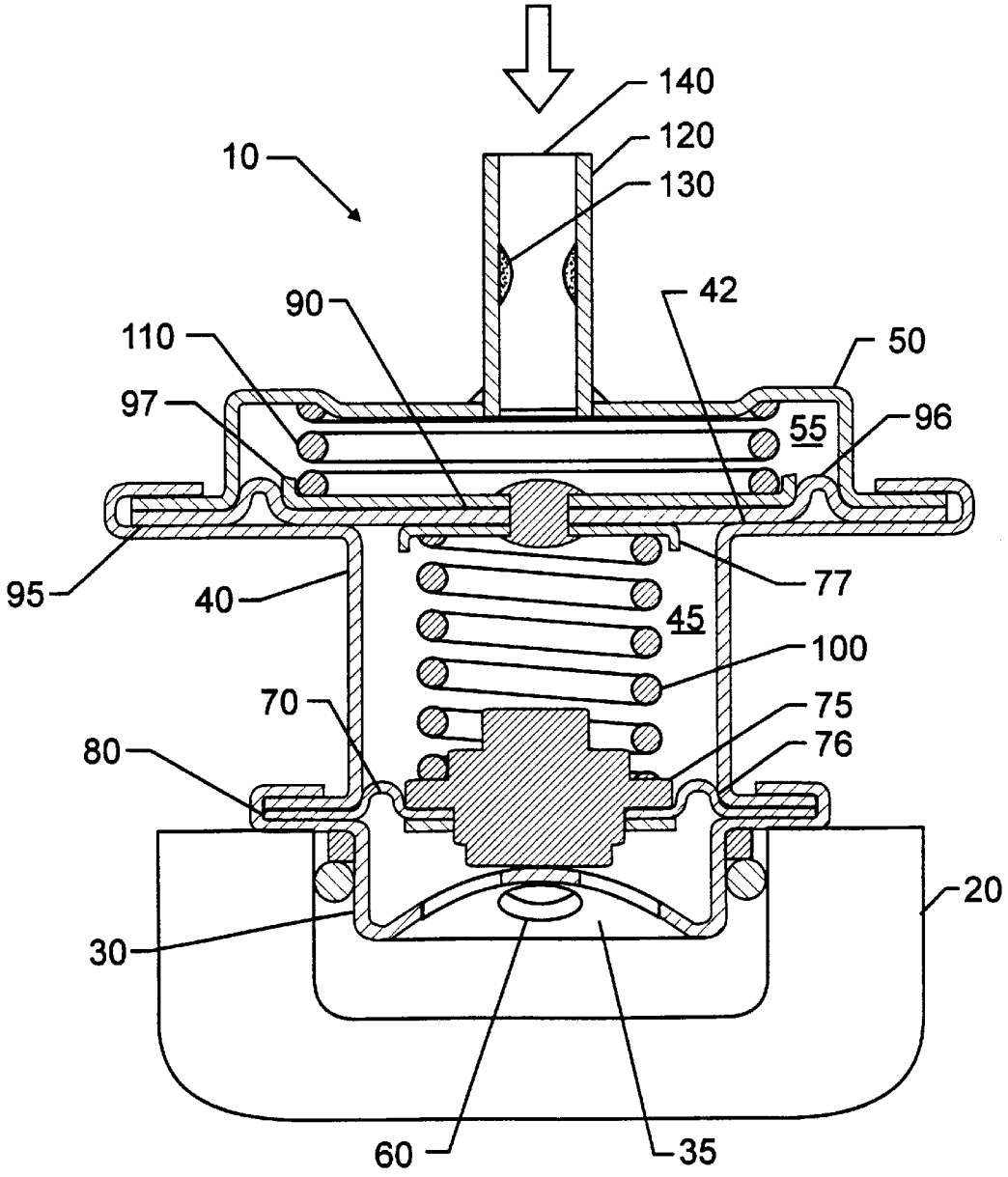
FIG. 1 is a cross section view of a fuel system damper with the vacuum bias diaphragm biased against the upper edge of the center housing.

FIG. 1 illustrates a damper 10 disposed in a fuel rail 20. The body of the damper 10 is comprised of a bottom cup 30, a center housing 40, and a top cup 50. The bottom surface

35 of the bottom cup 30 has an inlet 60 that allows fuel in the fuel rail 20 to enter the bottom cup 30 and communicate with a damper diaphragm 70 that is attached at its edge 80 in a sealing manner between the bottom cup 30 and the center housing 40. A vacuum bias diaphragm 90 is attached at its edges 95 in a sealing manner between the center housing 40 and the top cup 50. A damper spring 100 is disposed in the center housing 40 between the damper diaphragm 70 and the vacuum bias diaphragm 90, and is seated at one end in a damper seat 75 and at the other end in a first spring seat 77, such that the damper spring 100 biases the damper seat 75 towards the damper diaphragm 70.

A vacuum bias spring 110 is disposed in the top cup 50 and seated in a second spring seat 97 which rests on the vacuum bias diaphragm 90, such that the vacuum bias spring 110 biases the second spring seat 97 against the vacuum bias diaphragm 90. The second spring seat 97 is larger than the opening of the center housing 40 so that the upper edge 42 of the center housing 40 acts to stop the travel of the second spring seat 97 and vacuum bias diaphragm 90 as they are biased downward by the vacuum bias spring 110. The damper diaphragm 70 and the vacuum bias diaphragm 90 have convolutions 76, 96 that enable a larger range of travel of the diaphragms 70, 90. The damper diaphragm 70 and the damper spring 100 can be current production components used in vented dampers.

The damper diaphragm 70 and damper spring 100 are generally smaller than the vacuum bias diaphragm 90 and vacuum bias spring 110; and, during steady state operating conditions, the vacuum bias diaphragm 90 is in its fully biased position, as shown in FIG. 1. Since the spring rate for the vacuum bias spring 110 is larger than the spring rate for the damper spring 100, the vacuum bias diaphragm 90 and vacuum bias spring 110 provide support for the damper spring 100. Thus, during steady state operating conditions, the damper diaphragm 70 and damper spring 100 move in response to fuel pressure pulsations in the fuel rail 20 to eliminate the fuel pressure pulsations, but the vacuum bias diaphragm 90, which is biased by the larger vacuum bias spring 110, does not change its position. This difference in spring rate assures that the normal pressure pulsations in the fuel are controlled by movement of the damper spring 100 alone. The difference in spring rate can be reduced if desired, but should be adjusted to accommodate the anticipated magnitude of the fuel pressure pulsations.

Figure 2:
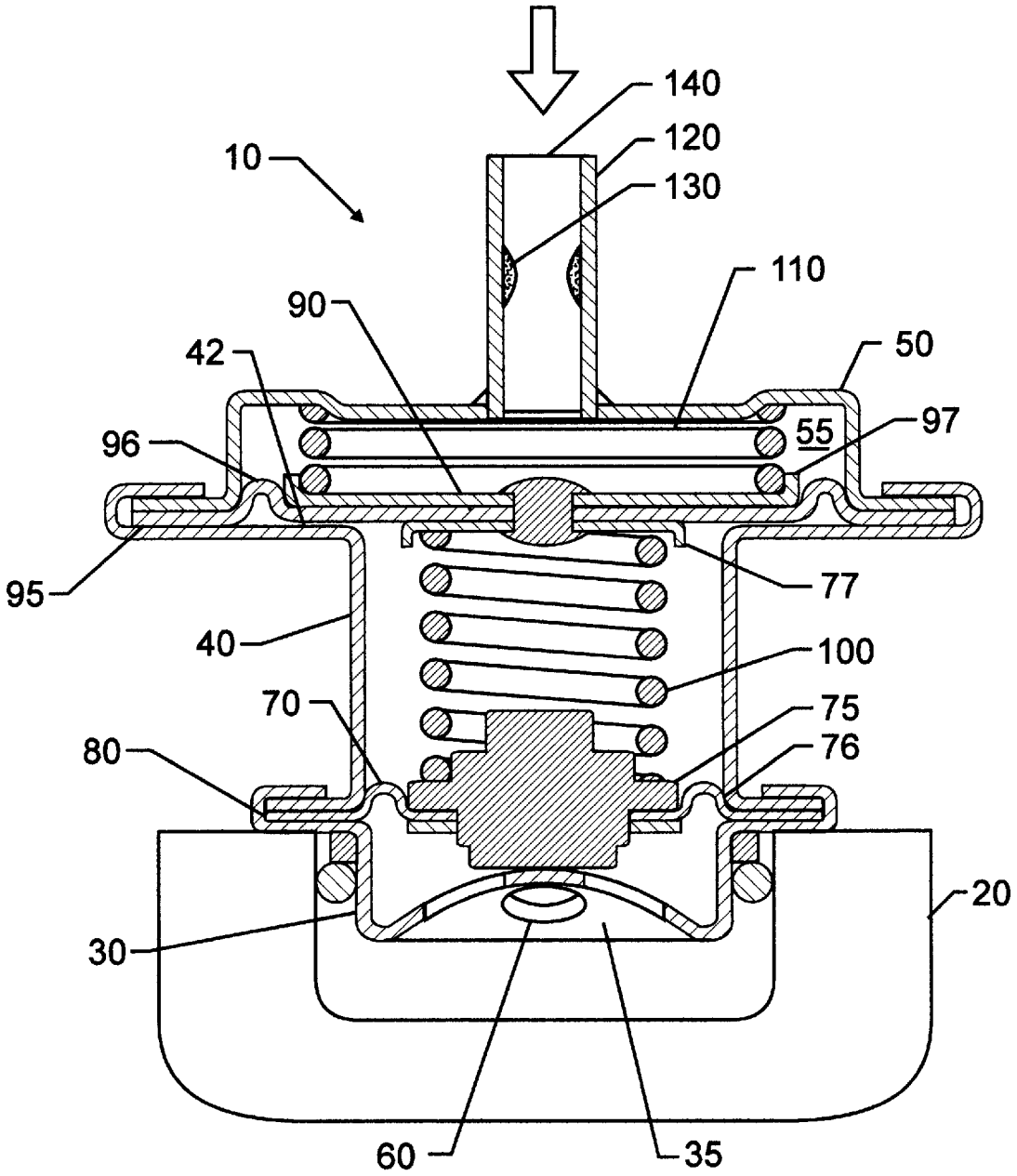
FIG. 2 is a cross section view of the damper of FIG. 1, with the vacuum bias diaphragm displaced upwards.

The top cup 50 has a manifold outlet 120 that communicates with the engine intake manifold (not shown) so that changes in pressure in the engine intake manifold affect the pressure within the top cup 50. During rapid deceleration, the engine intake manifold pressure decreases to very low levels. As illustrated in FIG. 2, when this occurs, the pressure above the vacuum bias diaphragm 90 will also reduce and cause it to move upward against the biasing force of the vacuum bias spring 110. This upward movement of the vacuum bias diaphragm 90 removes load from the damper spring 100. The removal of load from the damper spring 100 allows the damper spring 100, and thus the damper diaphragm 70, to travel upward, effectively adding volume to the fuel rail 20 and reducing the pressure in the fuel rail 20. The reduction in fuel pressure will continue with the upward movement of the vacuum bias diaphragm 90 and the damper diaphragm 70 until the pressure regulation setpoint is reached. At that point, the regulator (not shown) will supply fuel to maintain pressure as the damper diaphragm 70 moves further. Maintenance of the desired operating pressure in the fuel system will prevent the occurrence of malfunctions in the vehicle as a result of pressure fluctuations.

The outlet 120 is generally 3–5 mm in diameter; but the diameter can be changed to vary the rate at which the pressure in the top cup 50 changes, and thus vary the speed with which the vacuum bias diaphragm 90 moves in response to the pressure in the engine intake manifold. Also, to adjust the operation of the vacuum bias feature, a restrictor 130 is provided in the manifold outlet 120 that communicates with the engine intake manifold. The restrictor 130 can be formed, for example, by attaching a structure such as a ring to the interior wall of the outlet 120, or by forming a restriction in the outlet 120 by mechanical deformation. Decreasing the size of the opening 140 of the outlet 120 will delay the movement of the vacuum bias diaphragm 90 relative to a change in engine intake manifold pressure. Increasing the size of the opening 140 will make the vacuum bias diaphragm 90 respond more quickly to pressure changes in the engine intake manifold pressure. Additionally, the spring rate of the vacuum bias spring 110 can be adjusted to further tailor the operation of this feature. For example, a higher spring rate requires a higher vacuum in the top cup 50 to initiate movement of the vacuum bias diaphragm 90.

As an example only, a 32 mm diameter vacuum bias diaphragm 90 in a damper 10 according to the present invention can be designed to have a deflection of about 0.5 mm if the spring rate of the vacuum bias spring 110 is 80 N/mm, and the spring rate of the damper spring 100 is 80 N/mm. The actual desired ratios of the spring rates of the damper spring 100 and the vacuum bias spring 110 are selected based on the anticipated fuel pressures in the fuel rail 20, the type and size of the engine, as well as the desired pressure threshold at which the vacuum bias spring 110 will react to pressure changes within the top cup 50.

The foregoing description of the preferred embodiment of the invention has been presented for the purpose of illustration and description. It will be apparent to those skilled in the art that the disclosed embodiments may be modified in light of the above teachings without departing from the scope of the invention. For example, the present invention can be used in dampers having non-convoluted diaphragms, or in dampers having a solid diaphragm surface, i.e., without the presence of a damper seat 75. The diaphragms 70, 90 may also be attached within the damper by any suitable attachment means other than crimping, as long as the attachment means provides the desired seal across the diaphragm; for example, by clamping or bonding the diaphragms in place. In addition, the present invention is not limited by engine type or size. In engines having more cylinders or having higher fuel rail volumes, the spring rate of the vacuum bias spring 110 may be lowered to allow more travel of the spring, or the diameter of the restrictor 130 in the outlet may be increased to permit more rapid response of the vacuum bias spring 110 to pressure changes in the engine intake manifold. The helically coiled vacuum bias spring 110 can also be replaced by other conventional structures capable of providing a biasing action. Also, although the vacuum bias diaphragm 90 has been illustrated as fully biased against the upper edge 42 of the center housing 40 during steady state conditions, it should be understood that the steady state operating position of the vacuum bias diaphragm 90 can also be spaced a distance above the upper edge 42 of the center housing 40.

What is claimed is:

1. A damper for automotive fuel systems, the damper comprising:

a center chamber;

a top chamber having a vacuum outlet extending from the top chamber and capable of being connected to and communicating with an engine intake manifold;

a bottom chamber, wherein the bottom chamber has a fuel outlet to receive a fluid having pressure variations;

a first diaphragm sealingly separating the bottom chamber from the center chamber;

a second diaphragm sealingly separating the center chamber from the top chamber;

a first spring disposed in the center chamber and biased against the first and second diaphragms; and a second spring disposed in the top chamber and biased against the second diaphragm, wherein the spring rate of the first spring is less than the spring rate of the second spring.

2. The damper of claim 1, wherein the spring rate of the second spring is about ten times greater than the spring rate of the first spring.

3. The damper of claim 2, further comprising a restrictor in the vacuum outlet.

4. The damper of claim 3, wherein the top chamber is defined by the second diaphragm and a first cup member.

5. The damper of claim 4, wherein the bottom chamber is defined by the first diaphragm and a second cup member.

6. The damper of claim 5, further comprising a damper seat in the first diaphragm.

7. The damper of claim 6, further comprising a spring seat supporting the second spring against the second diaphragm.

8. A damper for automotive fuel systems, the damper comprising:

a center chamber;

a top chamber having a vacuum responsive means communicating with an engine intake manifold;

a bottom chamber, wherein the bottom chamber has a fuel outlet to receive a fluid having pressure variations;

a first diaphragm sealingly separating the bottom chamber from the center chamber;

a second diaphragm sealingly separating the center chamber from the top chamber;

a first spring disposed in the center chamber and biased against the first and second diaphragms; and a second spring disposed in the top chamber and biased against the second diaphragm, the spring rate of the first spring being less than the spring rate of the second spring.

9. The damper of claim 8, wherein the spring rate of the second spring is about ten times greater than the spring rate of the first spring.

10. The damper of claim 9, wherein the vacuum responsive means has a vacuum restrictor.

11. A method of relieving large magnitude transient pressure changes in a fuel rail of an automotive fuel system, the automotive system having an engine intake manifold and a damper, the damper having a first diaphragm separating a first sealed chamber from a second chamber with a fuel outlet to receive a fluid having pressure variations, and a damper spring in the first chamber biased at a first end against the diaphragm, the method comprising the steps of:

supporting the damper spring at a second end at a selected position during steady state operating pressures in the fuel system;

reducing pressure in the fuel rail by moving the position of the second end of the damper spring away from the diaphragm in response to an increase in vacuum in the engine intake manifold; and returning the second end of the damper spring to the selected position when the pressure in the fuel system is within steady state operating conditions.

12. The method of claim 11, wherein the damper spring is supported at its second end against a support diaphragm sealingly separating the first sealed chamber from a top chamber having on outlet communicating with the engine intake manifold, the top chamber having a support spring biasing the support diaphragm towards the damper spring, the spring constant of the support spring being greater than the spring constant of the damper spring.

13. The method of claim 12, wherein the spring rate of the support spring is about ten times greater than the spring rate of the damper spring.

14. The method of claim 13, wherein the outlet has a restrictor.

* * * * *

UNITED STATES PATENT AND TRADEMARK OFFICE

CERTIFICATE OF CORRECTION

PATENT NO. : 5,934,251

DATED : August 10, 1999

INVENTOR(S) : Michael Alan Jacobs

It is certified that error appears in the above-identified patent and that said Letters Patent is hereby corrected as shown below:

Column 3, Line 26 change "80" to - - 8 - -

Signed and Sealed this

Second Day of January, 2001

*Attest:*

*Attesting Officer*

Q. TODD DICKINSON

*Commissioner of Patents and Trademarks*